US005310067A

United States Patent [19]

Morrow

[11] Patent Number: 5,310,067

[45] Date of Patent: May 10, 1994

[54] COMPENSATING CRANE AND METHOD

[76] Inventor: William D. Morrow, 16350 Park Ten Pl., Ste. 202, Houston, Tex. 77084

[21] Appl. No.: 747,747

[22] Filed: Aug. 20, 1991

[51] Int. Cl.[5] ..... B66C 23/84

[52] U.S. Cl. ..... 212/253; 384/312; 384/591

[58] Field of Search ..... 212/190, 191, 253; 384/591, 309, 310, 311, 312

[56] References Cited

U.S. PATENT DOCUMENTS

| | | | |
|---|---|---|---|
| 1,279,644 | 9/1918 | Brown | 212/253 |
| 1,721,777 | 7/1929 | Gluckstein | 212/253 |
| 2,460,810 | 2/1949 | Davidson | 384/591 |
| 2,512,477 | 6/1950 | Bowes | 384/591 |
| 4,354,606 | 10/1982 | Morrow et al. | 212/253 |
| 4,524,875 | 6/1985 | Jamieson | 212/253 |
| 4,688,688 | 8/1987 | Volakakis et al. | 212/253 |

*Primary Examiner*—Michael S. Huppert
*Assistant Examiner*—Thomas J. Brahan
*Attorney, Agent, or Firm*—Kenneth A. Keeling

[57] ABSTRACT

A crane design which automatically self-compensates for misalignment between the longitudinal axis of the central support for such crane and the actual axis of rotation of the upperworks thereof when under load. Means for accomplishing both translational and rotational correction as needed are disclosed. Also, method for accomplishing the same.

3 Claims, 3 Drawing Sheets

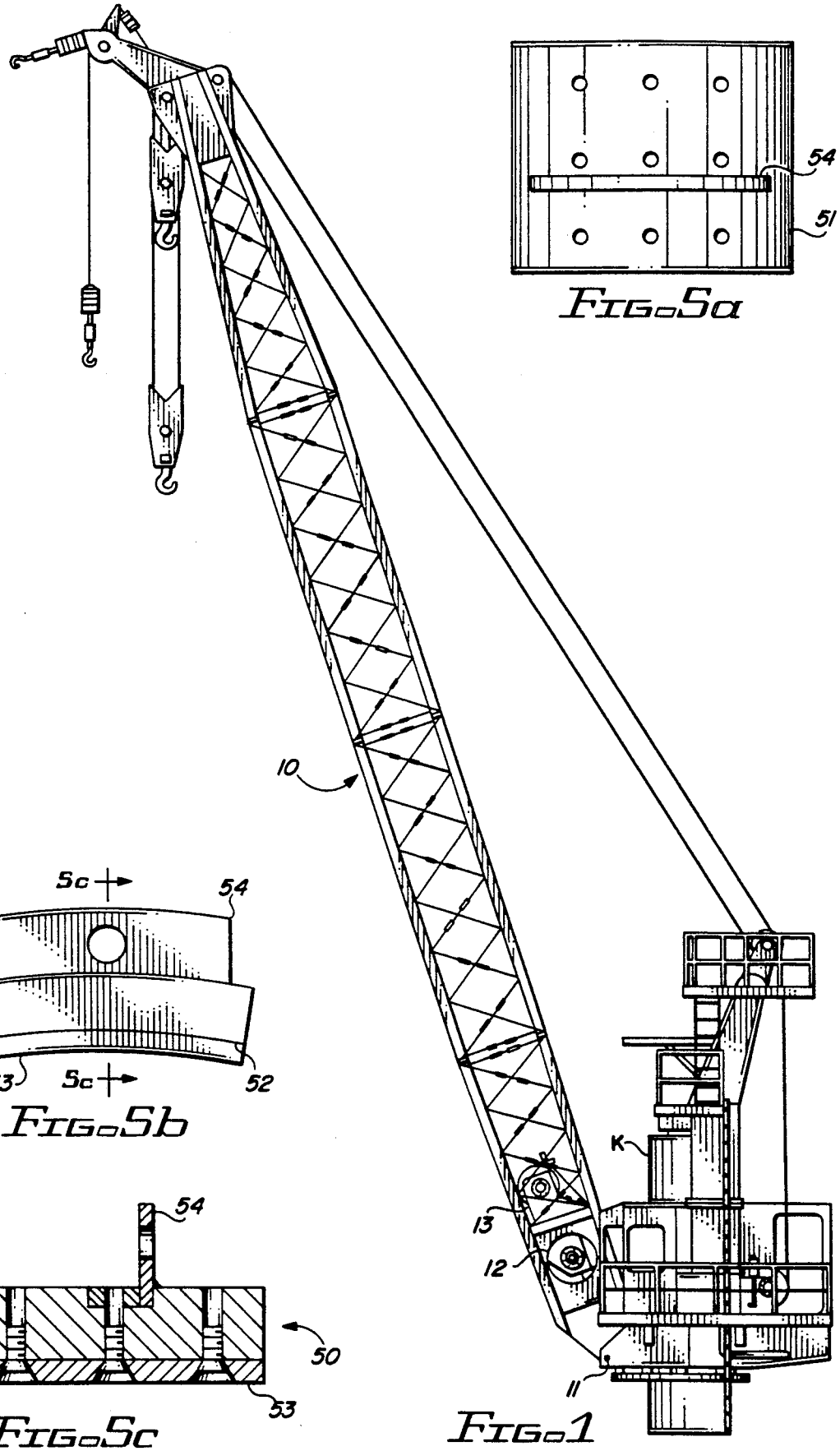
FIG. 1
FIG. 5a
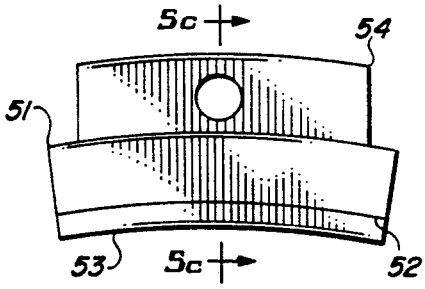
FIG. 5b
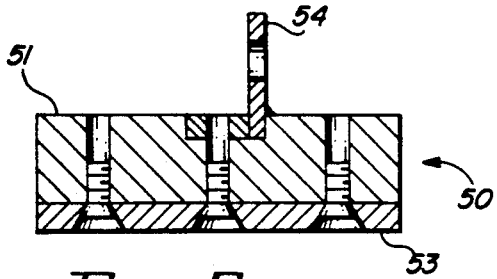
FIG. 5c

COMPENSATING CRANE AND METHOD

RELATED PATENT APPLICATIONS

This application is related to co-pending patent application Ser. No. 07/667,196, filed Mar. 11, 1991, now abandoned.

BACKGROUND OF THE INVENTION

This invention relates to a novel type of crane useful in many different environments but having particular usefullness in offshore applications. It overcomes problems which have long vexed the operators of offshore production facilities and marine drilling rigs of all types.

Offshore platforms need cranes to rapidly and safely load and off-load various material and personnel from floating vessels in the open sea to and from the fixed structures. The primary loads imposed upon such cranes are essentially of two types, a vertical load and an overturning moment. The vertical load in turn may be considered to consist primarily of two components, the dead weight of the crane structure itself and the actual load being lifted under dynamic conditions. It is to be realized that such conditions can be extremely dynamic, as, for example, when a vessel suddenly drops from the top of a wave to the bottom of a trough without adequate slack in the lines to compensate for such a rapid displacement. The dynamic loading of such cranes under such conditions can be, and often is, quite severe. The overturning moment is essentially the product of the dynamic load and the distance from the load to the centerline of rotation of the crane. This overturning moment is often applied impulsively.

Dockside cranes have long encountered similar conditions. The engineers of the eighteenth and nineteenth centuries attempted to resolve these problems by separating a pair of bearings or pivot points as widely as possible from each other. Perhaps because of the long-standing tradition with masts and riggings of sailing vessels, these early engineers separated these bearings vertically and resolved the overturning moment by a permanently mounted foundation fixed to the earth.

It eventually was realized that the utilization of these early cranes and derricks could be increased were they movable from place to place. The desire for such mobility presented two primary requirements which may be fairly said to have led directly to the configuration of the modern construction cranes which have been adapted for use in the offshore petroleum industry.

The first requirement for mobility was that such cranes could no longer be permanently attached to a foundation fixed to the earth. This in turn directly led to the use of counterweights to create an approximately equal but opposite overturning moment or couple to that created by the load, thus essentially reducing the loading on such mobile cranes to a vertical load on the wheels or tracks—in essence a balancing operation. It was soon realized that the actual weight or mass of the counterweight could be significantly reduced by causing it to rotate with the crane, thereby keeping it in the most advantageous position with respect to the load. It was also soon realized that the weight of the crane boom itself and any portion of the crane structure on the load side of the centerline of rotation significantly reduced the lifting capability of such cranes, thus spurring considerable effort to develop light weight and highly stressed boom structures, often of exotic materials.

The second requirement for mobility was a limitation on height to clear overhead obstructions, which precluded the use of a pair of vertically separated bearing assemblies. It then became necessary to resist the overturning moment by horizontally spaced bearings situated close together. Because such cranes typically must be capable of revolving 360°, such bearing arrangements typically took the form of a circle. The two methods in use today for this purpose are known as Hook Rollers and Ball Rings, with the latter sometimes being referred to also as Slewing Rings.

When offshore oil exploration beyond the sight of land was first accomplished around 1947, the only cranes available were construction cranes which had evolved as outlined above. These cranes had many shortcomings when removed from their intended application and transferred to offshore platforms to transfer material and personnel from floating vessels in the open sea. The balancing condition—or, more precisely, the impending loss of balance—could no longer satisfactorily be used to warn of impending overload situations when loading from a heaving vessel, a condition which frequently resulted in cranes being toppled into the ocean.

Mere removal of the undercarriage and permanent attachment of the rotating superstructure to the platform were only marginal improvements at best since impending unbalance could no longer be used as a 'safety valve' when loading such cranes offshore. Designers necessarily had to strengthen such designs considerably in order for such cranes to have any chance at all of performing their intended functions, and the resulting cranes were extremely heavy, expensive and still unsatisfactory in operations.

A very few designers decided to design cranes specifically for the offshore industry and to be affixed permanently to offshore platforms. Since such cranes had no need for mobility, low height was no longer a requirement, and vertically separated bearing assemblies could again be employed. The affixable, pedestal-type crane with center post (or 'king' post) removed both the requirement for counterweights and the impetus for light weight, exotic boom structures since such cranes were intended only for fixed mounting.

The pedestal-type, center post, affixable crane was a considerable improvement over the "ball ring" or "slewing ring" cranes, which generally require removal of the entire crane rotating structure from the slew ring and platform in order for the bearing to be replaced. Additionally, such designs generally combined the bearing function and structural function into a single mechanical assembly—functions which have incompatible if not mutually exclusive characteristics in that bearings need very hard materials which are inherently brittle while structural members need ductile characteristics in order to withstand the repeated shock loadings to which offshore cranes are subjected. The king post design, on the other hand, allows replacement of the swing bearings without the use of another crane, and thus was seen as a significant advance in the state of the art.

Despite its many advantages, and despite the greater design freedom permitted by separation of the bearing and structural functions, the bearings of the king post designs continued to pose problems. U.S. Pat. No. 4,061,230, for which applicant was a co-inventor, discloses a plurality of roller assemblies attached to the rotating superstructure of the crane and disposed about the king post. Each such roller assembly comprises a pair of small diameter, horizontal rollers pivotable about an apex displaced from the central post in order to permit the roller assemblies to adapt to irregularities in the central or king post. However, this reference does not contemplate nor teach a unitary structure or method for permitting ease of access to such bearings for inspection or removal. While this design and similar designs are in frequent use, they suffer from a number of disadvantages. Unless such rollers are of extremely small diameter in comparison to the center post, they will require a good bit of space, and if they are comparatively small, the rollers will frequently slide on the king post rather than rotate about their axles. This condition becomes even more pronounced when any grease or oil accumulates on either the rollers or their track around the post, which in turn may cause 'flat spots' to wear on the rollers or cause the rollers to cut a groove in the post. The latter problem is frequently evident when the rollers are made of a material harder than that of the king post. Such a groove can lead to structural failure in the king post without warning, with the crane assembly falling from its mounting. Also, replacement of the rollers and/or roller assemblies is normally quite difficult because of the extremely tight space containing the same.

Attempts to overcome these problems directly led to a third generation of modern crane design. These designs generally affixed a removable wear strip to the center post and a mating ring to the rotating superstructure which slides on the stationary wear strip as the superstructure revolves about the king post. This concept is exemplified by U.S. Pat. No. 4,184,600 to applicant and another. While overcoming the problems of the multiple roller design and experiencing considerable commercial success, such designs are not themselves without disadvantages. The wear strips must of necessity be installed on the center posts before the superstructures are mounted, and the clearances therebetween must necessarily be quite small. Since such superstructures may be quite large and heavy objects, it is not always easy to maneuver them into place with the degree of precision required, particularly if the lifting crane is on a vessel. These factors result all too often in damage to or even destruction of the wear strips during installation of the superstructure over the king post. Additionally, such wear strips are quite difficult to install properly. Ordinarily the wear strips will not fit absolutely tightly around the center post, which can result in a bulge or wave in the strips as the crane is revolved. This in turn leads to premature failure of the wear strip fasteners, thus allowing the strips to slide about and be destroyed in short order.

Still another disadvantage of such a bearing design arises from the inevitable misalignment between the axis of rotation of the superstructure under load and the vertical axis of the center post. Although quite small, this angular misalignment causes the lower edge of the mating ring affixed to the rotating superstructure to tend to cut the stationary wear strip. While such bearings may be replaced with considerably less difficulty than those of previous designs, it is nevertheless a not insignificant inconvenience and expense to have to replace such bearings prematurely.

Attempts to overcome these disadvantageous features in turn led to the fourth generation of modern pedestal-type cranes as exemplified by U.S. Pat. No. 4,354,606 to applicant and another. This design utilizes removeable semicircular shoes mounted within the rotating superstructure to which the wear strips are then affixed. Since the wear strips need not be affixed prior to mounting the superstructure, and since the superstructure need only be centered about the center post as taught in U.S. Pat. No. 4,184,600 and not elevated as required by the '600 design, the damage or destruction to the wear strip during installation is eliminated. However, this design is also subject to angular misalignment between center post and superstructure, which causes extremely high point or line loading of the wear strips. This tendency toward point loading is exacerbated by the necessary difference between the inside diameter of the shoes with wear strips attached and the outside diameter of the center post, resulting in only a very small portion of the wear strips actually being in contact with the pedestal when under load, which in turn results in a relatively low load carrying capability for the shoes.

Owing to the "point" or "line" nature of the loading, the load carrying capability cannot be increased simply by the expedient of enlarging the bearing surface area: only a small fraction of the existing bearing surface area is actually utilizeable, and increasing the surface area of such bearings would only increase the amount of unused bearing area, and would not increase the load carrying capability at all. To increase the actual load carrying capability of such cranes, their designers greatly increased the separation between the upper and lower horizontal bearings. This in turn results in cranes which are 'over tall' in relation to their moment-resisting ability and which are somewhat overweight when compared to similar capacity cranes of other designs. Heretofore, these height and weight penalties were not critical, but with growing concern about helicopter safety—and increasing regulations limiting approach angles to helipads—the allowable heights of platform equipment such as cranes are becoming more limited. Additionally, the increased quality controls placed on the industry have combined with the increasing price of steel to cause the costs of fabricated steel weldments such as center posts and rotating superstructures to increase radically in recent years.

Thus for safety reasons the industry is in urgent need of an improved crane design which can transmit larger actual bearing loads with a significantly reduced overall height and which can operate in the offshore environment without potentially catastrophic defects building up latently. In addition there is a pressing economical need for an improved design that will reduce the initial capital cost required and which can extend the intervals between bearing replacements with their associated high downtime costs.

SUMMARY OF THE INVENTION

All center post crane designs known to applicant inevitably and inherently incorporate an angular misalignment between the longitudinal axis of the center post and the actual axis of rotation of the superstructure when under load. In an ideal embodiment of the present invention a design is utilized which automatically adjusts itself to compensate for this inherent angular misalignment, which eliminates the point loading problems of the bearing surfaces of prior designs, which reduces bearing destruction and replacement, and which permits the transfer of significantly greater over turning moments than is permitted by similar sized cranes of prior designs. Stated otherwise, a compensating crane of the preferred embodiment of the same size and strength of materials as prior art non-compensating cranes should be able to resist at least twice the overturning moment of such prior art cranes. Thus a user may select a comparably-sized compensating crane and realize a radically greater safety factor in actual use, or he may select a smaller-sized compensating crane with the same load capability and realize a considerable savings in initial cost, weight, bulk, and maintenance. Additionally, a comparably-sized ideal embodiment will provide a significantly shorter post height—as much as 40% shorter for some models—with a corresponding increase in safety for flight personnel and greater storm safety. Also such an ideal embodiment permits the rapid replacement of worn bearings or bearing assemblies without the need to remove the superstructure from the post or platform.

BRIEF DESCRIPTION OF THE DRAWINGS

FIG. 1 is an elevational view of a pedestal crane showing a pedestal crane assembly surmounting a pedestal;

FIGS. 5*a*, 5*b*, and 5*c* comprise a three-view detail of the structure to be assembled into the structure of FIG. 3;

DESCRIPTION OF THE PREFERRED EMBODIMENT

It is to be understood that the principles of this invention have applicability to a wide variety of crane designs and to a wide variety of applications beyond the offshore petroleum industry. It is also to be understood that, once the principles of this invention have been learned, they may be implemented in divers forms of apparatus and/or methods. The design is particularly suitable for fabrication of major components from conventional steel, although high strength steels or other suitable high strength materials may be used if desired.

Figure 2:
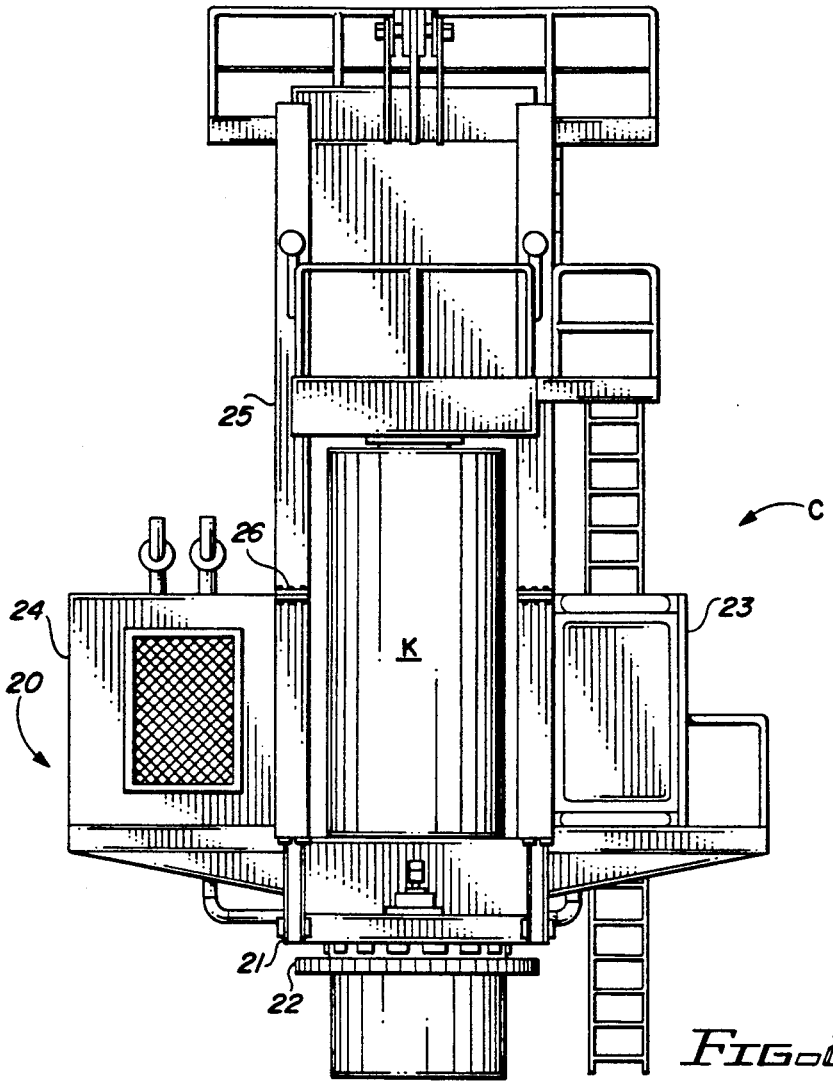
FIG. 2 is a frontal view of the structure of FIG. 1 with the boom assembly removed for clarity.

As shown in FIG. 1, the crane assembly C includes a boom designated generally as 10 which is affixed to the superstructure designated generally as 20 and with respect to which the boom 10 is free to rotate about a horizontal axis 11. The king post K may be rigidly mounted to any desired supporting structure (not shown) such as a pedestal of an offshore platform, a moveable vehicular frame, a permanent foundation embedded in the earth, or any other such structure. Superstructure 20 generally includes a baseplate 21 which rotates with such superstructure. If desired, a cylindrical sleeve surmounting the greater part of king post K above sprocket gear 22 may be incorporated into the superstructure, but such a structure is not needed for strength reasons and the associated cost and weight thereof may be eliminatd by foregoing such a cylinder. Rather, the king post K may be left almost completely exposed, as is more clearly shown in FIG. 2, except for that relatively small portion obscured by the lower portion of the superstructure 20.

Preferably, as shown in FIG. 1, the main hoist 12 and auxillary hoist 13 will be disposed within the boom 10 as taught in the prior art. So doing will provide a stable geometry for the crane under load, i.e., the position of the load (not shown) will not change with respect to the boom as boom 10 is raised or lowered by boom hoist 14. Provided that crane assembly C is adequately sized, boom 10 may comprise as many sections as desired to attain whatever working length may be desired, e.g., boom 10 may easily reach lengths of 80, 100 or even 120 feet.

Baseplate 21 supports a bearing assembly 50, which will be explained in more detail below, which resists horizontal motion and which transfers the lower component of the overturning moment imposed by loading. It is convenient to situate the operator's enclosure 23 of FIG. 2 and controls within superstructure 20 above baseplate 21 and to one side of king post K and to situate the motive power 24—diesel engine, electric motor, or whatever—similarly but to the other side of king post K. Superstructure 20 may conveniently be joined to gantry 25 by a plurality of bolts 26 or other convenient means. The assembled components which are supported by and revolvable about the central support are generally referred to as the upperworks.

In a king post design of the type illustrated, it is convenient to incorporate the self-adjusting or compensating features of the present invention in one or both bearing assemblies surrounding the central post K. Since the baseplate 21 rotates with superstructure 20 such that its orientation in the horizontal plane with respect to the load is fixed, the point or line loading effect discussed above is greatest in the direction of the load as shown by the bold arrow L of FIG. 3. This direction is also the direction in which maximum compensation is needed. Or, stated otherwise, it is an axis within the baseplate 21 perpendicular to load direction L about which compensation is needed and about which in the ideal embodiment of this invention the bearing sub-assemblies in the direction of the load are permitted to rotate. One could, were it desired so to do, extend the compensating principle of this invention to the individual bearings which are situated 90° away from the load direction such that these bearings could also rotate about their axes perpendicular to load direction L. However, since the load upon these bearings 90° away from the load direction is so small, comparatively, there is no need so to do.

Figure 3:
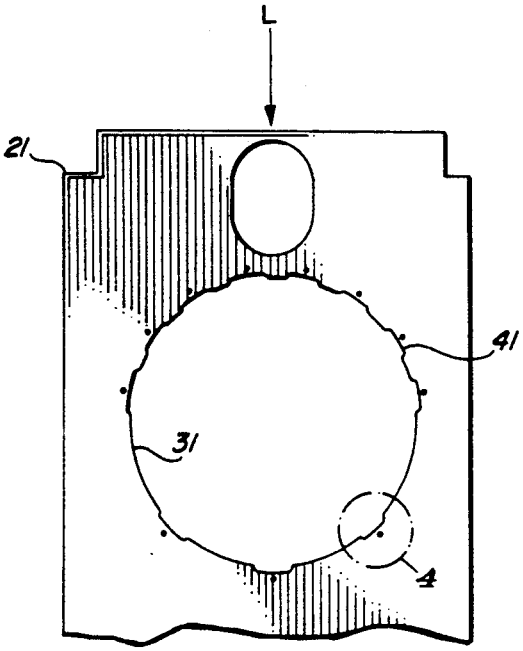
FIG. 3 is a plan view of a portion of the rotating superstructure baseplate as shown in FIG. 2.
Figure 4:
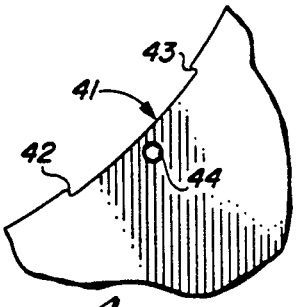
FIG. 4 is a plan view of a portion of the structure of FIG. 3, enlarged for clarity of detail.
Figure 6:
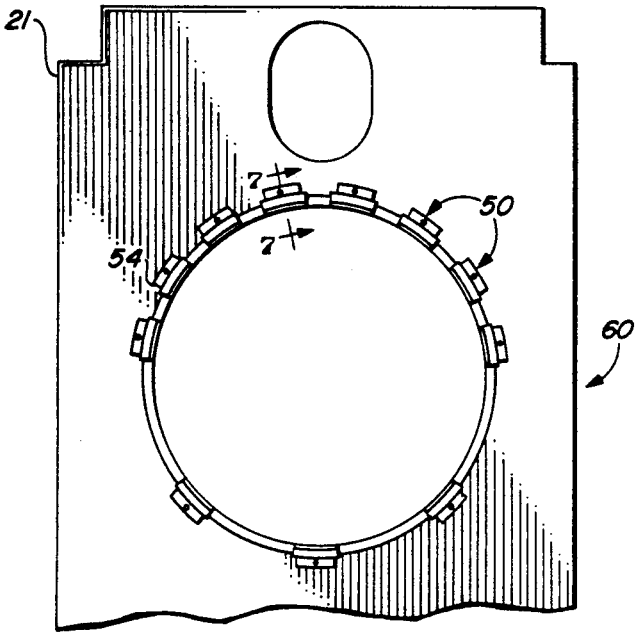
FIG. 6 is a plan view of the structure of FIG. 3 with the structure of FIG. 5 assembled therein.

It may be observed from FIGS. 3, 6 and 7 that it is preferred to form baseplate 21 of rotating superstructure 20 so as to receive the individual bearing sub-assemblies 50 and thus constitute a part of the overall or integrated bearing assembly 60. This may conveniently be accomplished by cutting a plurality of notches 41 in the otherwise circular surface 31 of baseplate 21; FIG. 4 shows one such detail for one such notch 41 enlarged for clarity. Sides 42 and 43 of notches 41 will serve to constrain the corresponding bearing sub-assemblies 50 from movement in either circumferential direction as the baseplate 21 and assemblies 50 are rotated about king post K.

Individual bearing sub-assemblies 50 may be seen from FIGS. 5 and 7 preferably to comprise a backing member 51 the inner surface 52 of which is preferably contoured to receive the outer circumferential portion of king post K. The actual wear material 53 may be joined to backing member 51 in any desired manner; it is shown in FIG. 7 as attached by a plurality of recessed retainer screws (preferably brass). The wear material itself may be Nylon, Nylatron, Teflon, acetal, bronze or any other suitable material. FIG. 5 most clearly shows a retainer member 54 attached as by welding to backing member 51. It is desired for wear material 53, backing member 51, and retainer member 54 to constitute a bearing sub-assembly 50 whose orientation is controllably yieldable about the aforesaid axis perpendicular to the direction of load L. A variety of schemes and designs for accomplishing this controlled compensation may be suggested once the need for such and applicant's preferred solution therefor have been understood, all of which may incorporate the principles of applicant's invention. Many of such suggestions may provide means for restoring such sub-assemblies or alternate bearing surfaces to their original positions when the load is removed, and for repeatedly compensating when under load. However, such a capability is not needed since the angular misalignment is so slight and since the load on the bearing surfaces from the weight of the crane alone (i.e., when unloaded) is so small comparatively; such a capability would be but a mere embellishment. Rather, it is adequate, and in fact permissive of a solution elegant in its simplicity, simply to have a structure which will controllably self-adjust to the maximum necessary displacement of the structure under the maximum permitted load. In the ideal embodiment, this is elegantly achieved by selecting the size and the material of retainer member 54 to have a strength and a yieldability which will permit sub-assembly 50 to rotate about its support about an axis perpendicular to the load direction (perpendicular to the plane of the paper containing FIG. 7) and to maintain such compensated position when the load is removed. One of the many variants which may be suggested, and one which would eliminate the illustrated welding step, would be to provide the retainer member 54 in the form of an angular member, one leg of which could be attached to the outer surface of backing member 51 by the same screws that attach the wear material 53 to the inner surface of member 51, or attached in such other member as may be desired.

It should also be noted that the outer surface of backing member 51 may take any convenient form desired, e.g., it may follow the contour of the inner surface of such member, or it may for example be straight, so long as the shape desired in cooperation with that of receiving notch 41 will permit the slight relative rotation necessary for such subassembly with respect to said receiving notch.

It may also be noted that the receiving hole 55 of retainer member 54 is shown in FIG. 5*a* as larger than the corresponding receiving hole 44 of the baseplate of FIG. 4. It is preferred for shoulder bolt 56, which clamps bearing sub-assembly 50 to baseplate 21, not to do so tightly as to prevent all movement in the radially outward direction from the centerline of the center post K. So doing will permit the crane of the present invention to automatically compensate for the aforesaid misalignment by radially outward displacement of the bearing sub-assemblies 50 in the direction of the load, in addition to compensating by permitting rotation of such sub-assemblies as explained hereinabove. Thus the ideal embodiments of this invention will permit self-compensation by either or both of two distinct means, acting independently or together as required, although the user may not elect to incorporate both such means.

When assembling the improved crane of the present invention under stable conditions, the sub-assemblies 50 may be pre-assembled and recessed to the maximum extent possible prior to being placed over the center post. When assembling under unstable conditions, some or all of the bearing subassemblies 50 may be left out until the superstructure is in place around the king post. In any event, since such subassemblies are readily accessible, they may be fitted after assembly, or inspected and replaced at later times, without removal of the superstructure.

Figure 7A:
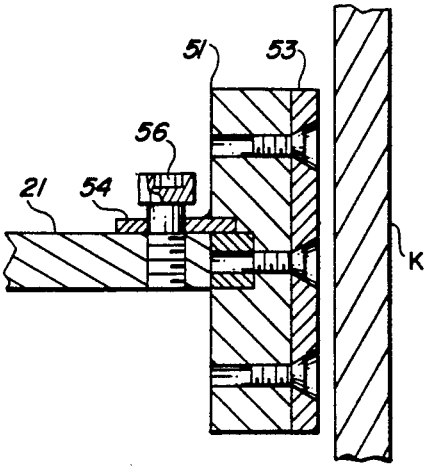
FIGS. 7*a* and 7*b* are elevational views in cross-section of portions of the structure of FIGS. 1, 3, and 5 before interaction or compensation and after interaction or compensation, respectively, with exaggerated separation and exaggerated misalignment for clarity.
Figure 7B:
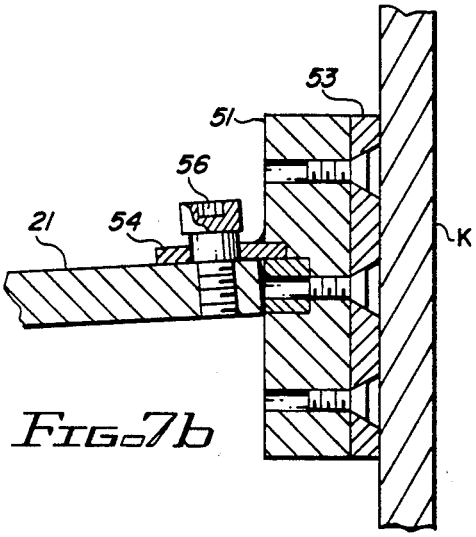

FIGS. 7*a* and 7*b* depict, in exaggerated fashion for clarity, "before" and "after" views of the principles disclosed hereinbefore. That is to say, FIG. 7*a* depicts a sectional view of a sub-assembly 50 in the direction of the load attached to baseplate 21 and parallel, or nearly so, with the outer wall of king post K, as such elements may be configured prior to attachment of boom 10; FIG. 7*b* depicts (exaggeratedly) such elements subsequent to loading. It may be noted that the sub-assembly 50 of FIG. 7*b* has been displaced and components 51 and 53 thereof have been rotated with respect to their prior position as depicted in FIG. 7*a*.

Figure 8:
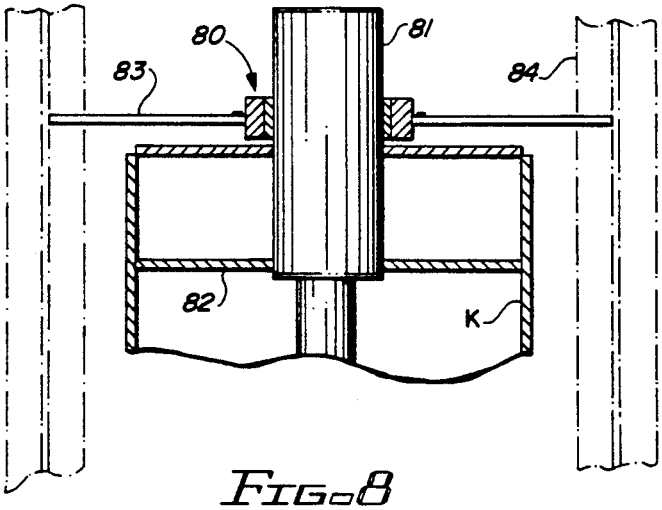
FIG. 8 is an elevational view in cross-section of the upper portion of center post K and superimposed structure.

As alluded to above, it is preferable but not essential to incorporate the automatic adjusting or compensating principles of this invention in both radial bearings surrounding the central support. As has been previously disclosed, it is also preferable to separate the functions of the vertical load resisting or thrust bearing and that bearing which will resist the upper component of the overturning moment. FIG. 8 discloses an elevational view in cross-section of the upper portion of the central support of the structure of FIGS. 1 and 2. Those skilled in the art will realize that the thrust bearing and the radial bearing may if desired be an integral piece, but if formed of separate pieces then either may be replaced without replacing the other. Those skilled in the art will also realize that a thrust bearing would surround the center pin 81 directly on top of the central post K, which thrust bearing is not shown in FIG. 8 for clarity.

Center pin 81 preferably extends both above and below the top of post K, and the lower end of such pin is supported by reinforcing member 82. Radial bearing assembly 80 may function in the same manner as heretofore explained for radial bearing assembly 50, and is shown supported by member 83 which is affixed to gantry structure 84. Various forms of bearing caps (not shown) may be employed to shield such assemblies from the elements, as is known by those skilled in the art.

As hereinbefore stated, it is within the concept of the present invention to employ means for compensating for the inevitable angular misalignment near either or both ends of the central support. Should it be desired to employ only one compensating means, it will be found preferable to situate such compensating means near the end opposite that about which the upperworks tends to rotate. Those skilled in the art, upon fully appreciating the teachings of the present invention, will realize that the principles herein could be applied equally well to cranes of inverted king post design, as well as to a number of other designs. Also, although not preferred, and although difficult to effect in practice, such compensation could be carried out manually.

Still other alternate forms of the present invention will suggest themselves from a consideration of the apparatus and practices hereinbefore discussed. Accordingly, it should be clearly understood that the apparatus and techniques depicted in the accompanying drawings and described in the foregoing explanations are intended as exemplary embodiments only of the present invention, and not as limitations thereto.

What is claimed as new and desired to be secured by Letters Patent of the United States is:

1. In a pedestal crane having upperworks and boom means, a self-adjusting bearing means disposed between said upperworks and pedestal means, comprising:

means for removably securing said bearing means within said upperworks against vertical displacement;

means for removably securing said bearing means against circumferential displacement;

means for permitting within limits the automatic translation of said bearing means in a generally horizontal plane under load; and means for permitting within limits the automatic angular rotation of said bearing means in a generally vertical plane under load, whereby said bearing means may automatically and controllably compensate for the angular misalignment between the longitudinal axis of said pedestal means and the axis of rotation of said upperworks and boom means.

2. In a pedestal crane having upperworks and boom means, a self-adjusting bearing means disposed about an upper portion of said pedestal means, comprising:

means for removably securing said bearing means about said upper portion against vertical displacement;

means for removably securing said bearing means against circumferential displacement;

means for permitting within limits the automatic translation of said bearing means in a generally horizontal plane under load; and means for permitting within limits the automatic angular rotation of said bearing means in a generally vertical plane under load, whereby said bearing means may automatically and controllably compensate for the angular misalignment between the longitudinal axis of said pedestal means and the axis of rotation of said upperworks and boom means.

3. In a crane having a central support and rotatable upperworks with an opening in the rotatable upperworks for receiving said central support, said rotatable upperworks including a boom mounted thereon for handling loads, a bearing assembly disposed in said opening between the rotatable upperworks and said central support comprising:

a plurality of sub-assemblies, each subassembly including a retainer, attachment means for removably attaching the retainer on the rotatable upperworks, a backing member attached to said retainers, wear material mounted on said backing member, said wear material disposed between said backing member and said central support;

each subassembly radially moveable within predetermined limits when said crane is placed under load; and means for mounting each sub-assembly to the rotatable upperworks to prevent circumferential movement of the subassemblies relative thereto.

* * * * *